United States Patent [19]

Castner, Sr. et al.

[11] Patent Number: 4,513,642

[45] Date of Patent: Apr. 30, 1985

[54] AUTOMATIC RETURN VARIABLE ADJUSTABLE WRENCH

[76] Inventors: John F. Castner, Sr., P.O. Box 7156, San Diego, Calif. 92107; Martin I. Sheps, 16139 Ladera Piedra Way, Poway, Calif. 92064

[21] Appl. No.: 489,542

[22] Filed: Apr. 28, 1983

[51] Int. Cl.[3] ..... B25B 13/00

[52] U.S. Cl. ..... 81/52; 81/177.8

[58] Field of Search ..... 81/53, 54, 177.8, 134, 81/135, 136, 137, 138, 139, 140

[56] References Cited

U.S. PATENT DOCUMENTS

| | | | |
|---|---|---|---|
| 607,320 | 7/1898 | Young . | |
| 805,328 | 11/1905 | Tacchi et al. | 81/53 |
| 834,242 | 10/1906 | Anderson | 81/177.9 |
| 912,507 | 2/1909 | Tacchi | 81/177.9 |
| 1,208,464 | 12/1916 | Booth et al. | 81/139 |
| 1,924,023 | 8/1933 | Carlberg | 81/177.8 |
| 3,659,485 | 5/1972 | Roth | 81/135 |
| 3,715,937 | 2/1973 | Cade et al. | 81/177.8 |

*Primary Examiner*—James L. Jones, Jr.

*Attorney, Agent, or Firm*—Hill, Van Santen, Steadman & Simpson

[57] ABSTRACT

A variable adjustable wrench adapted to tighten or loosen nuts and bolts in somewhat inaccessible locations, has a head which is rotatable with respect to the handle such that the angular relationship between the head and handle is variable. A retaining means holds the head in a fixed angular relationship to the handle during the application of a force to a nut or bolt and permits the angular relationship to change while a force is not applied such that a virtually inaccessible nut or bolt can be tightened or loosened by wiggling the handle of the wrench. Means are provided to return the head to the original position after the head has reached its limit of angular travel.

27 Claims, 14 Drawing Figures

FIG. 1
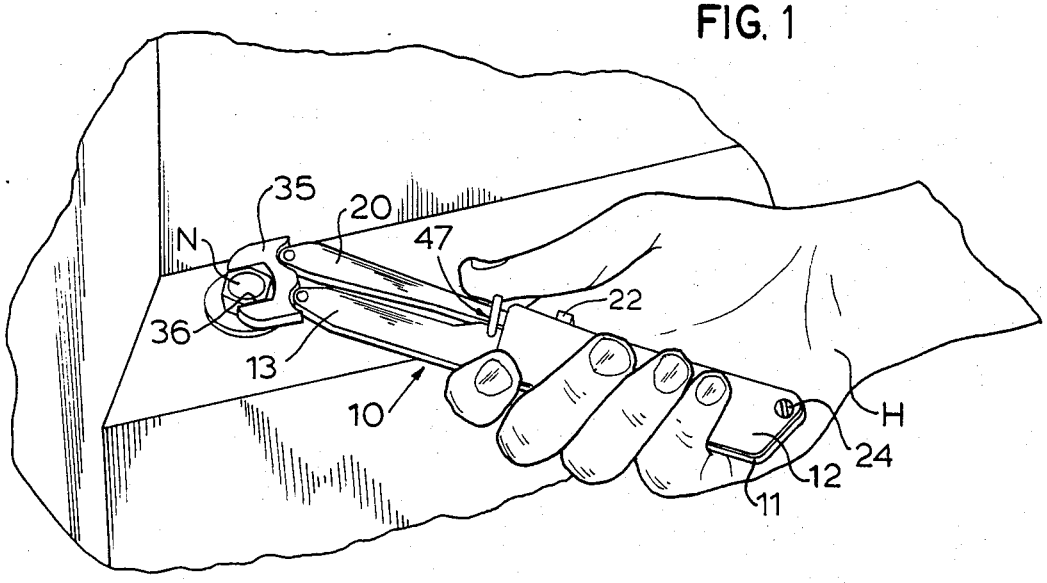
FIG 2
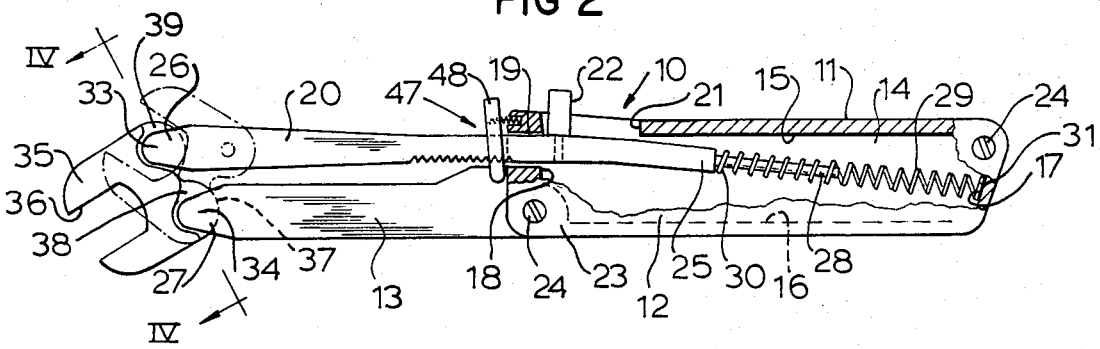
FIG 3
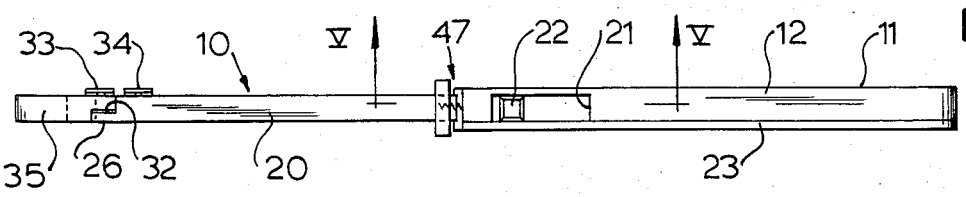
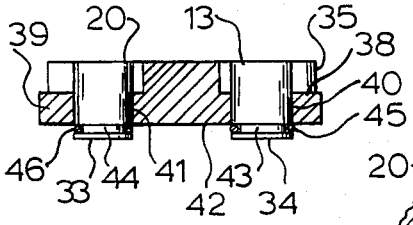
FIG 4
FIG 5
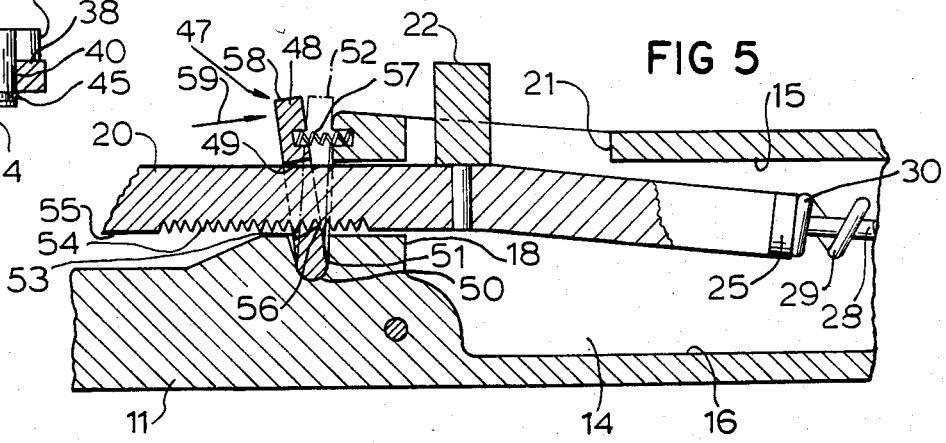

FIG 6
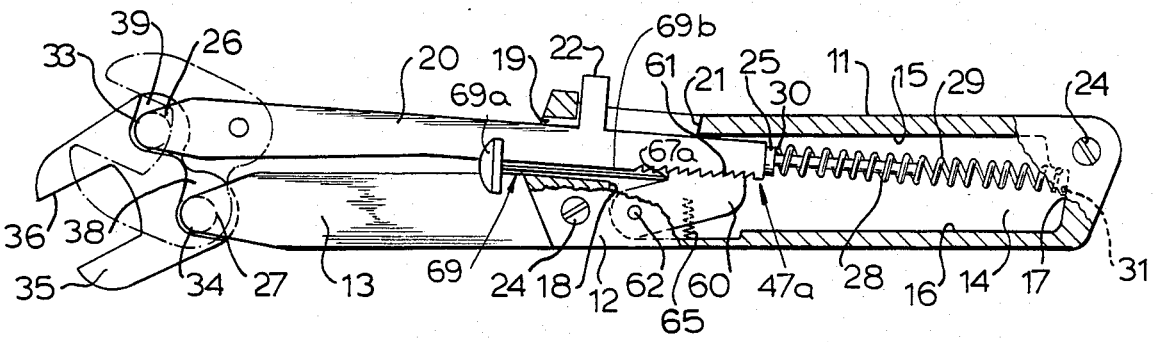
FIG 7
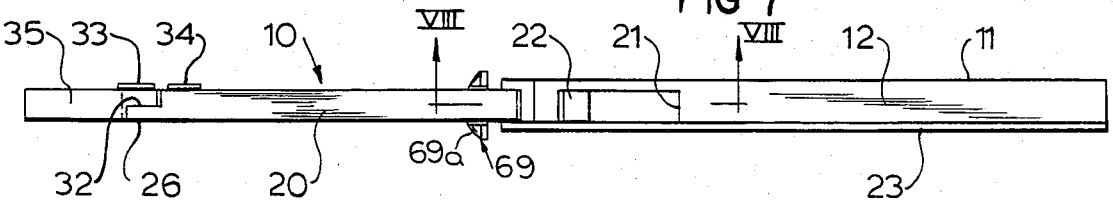
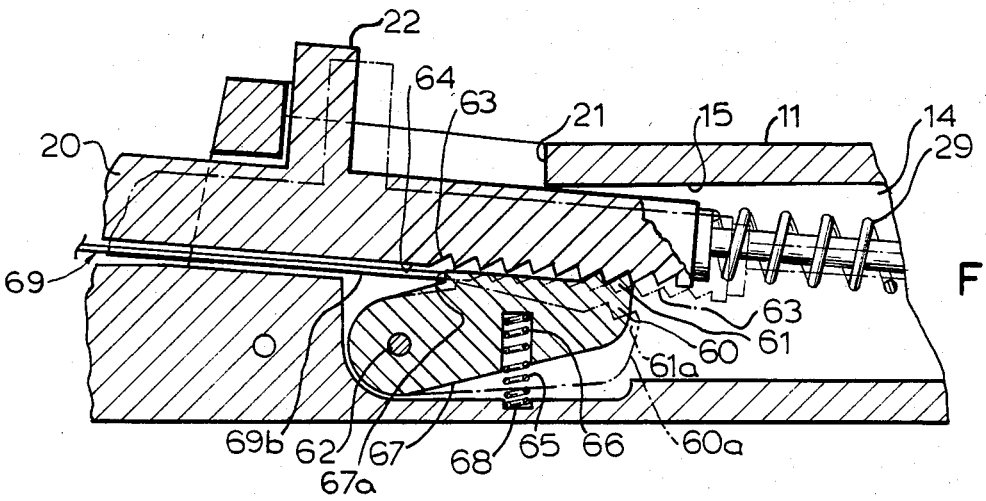
FIG 8
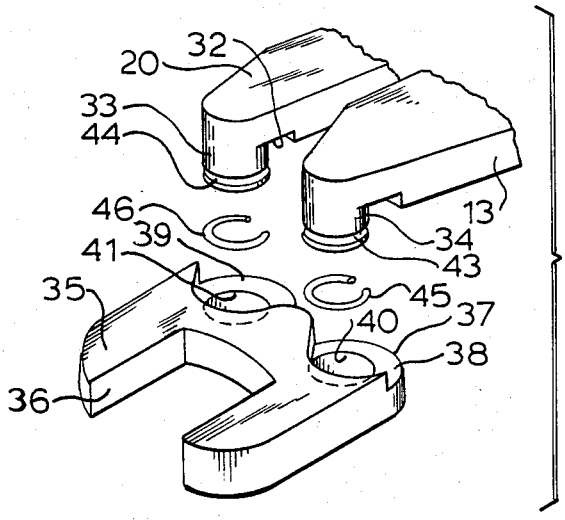
FIG 9

FIG 10
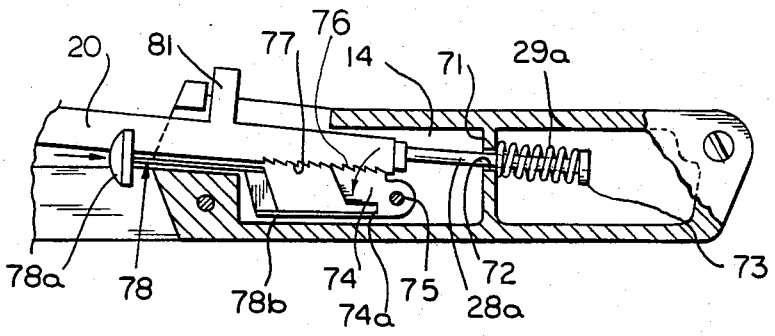
FIG 11
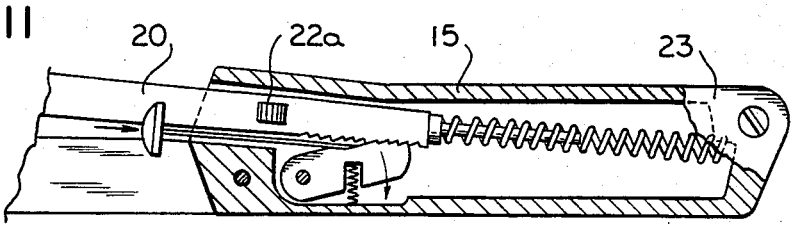
FIG 12
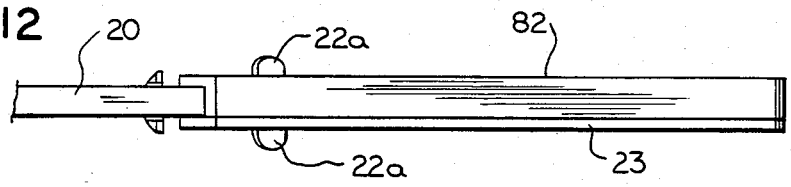
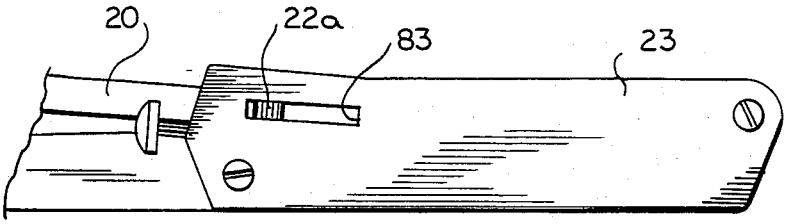
FIG 13
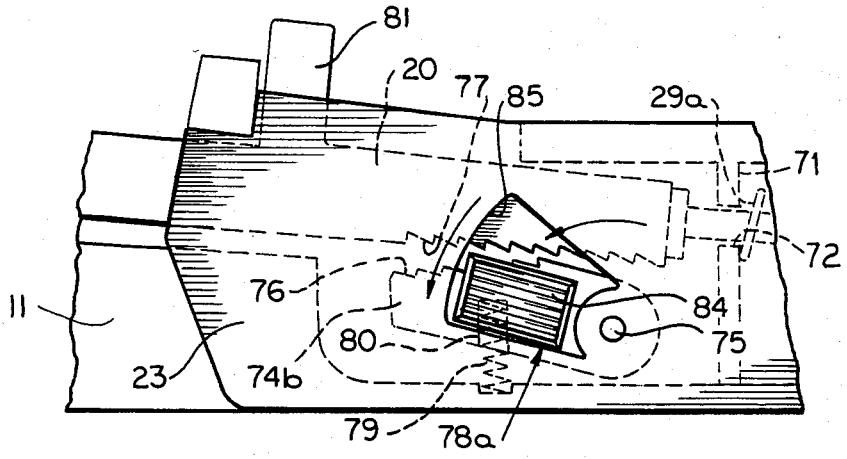
FIG 14

AUTOMATIC RETURN VARIABLE ADJUSTABLE WRENCH

FIELD OF THE INVENTION

This invention deals with end wrenches for tightening and loosening nuts and specifically relates to wrenches having adjustable positioned heads to provide a variable working wrench able to work in tight places.

PRIOR ART

Angularly adjustable wrenches have provided for a selectively movable head for receiving a nut which may be retained in a fixed angular position relative to the handle of the wrench for manipulating nuts or bolts in a limited work space. The angle of the head relative to the handle changes during the manipulation of a nut or bolt as the handle is oscillated between two end points of limited travel. When the head reaches a maximum angle with respect to the handle, the head must be removed from the nut and manually reset to the starting position. It would therefore be an improvement in the art to provide a variable adjustable wrench which would automatically return the head to an initial position as desired by the user.

SUMMARY OF THE INVENTION

According to this invention, there is provided a variable adjustable wrench having a removable head for receiving a nut or bolt which is pivotally attached to a wrench handle and is also pivotally attached to an arm received in the handle and which is selectively movable with respect to the handle such that the head can be selectively positioned through a range of angles with respect to the handle. An end of the arm may be captured within the hollow interior of the wrench handle and retains a spring biasing means which acts to cause the arm to move in an outward direction with respect to the handle towards a first or extended position. A second embodiment works oppositely in which the end of the arm captured within the wrench handle retains a biasing means which acts to cause the arm to move in an inward direction with respect to the handle towards a contracted position. Retaining means such as a dog and ratchet arrangement are provided to retain the head of the wrench in a fixed angle with respect to the handle. The retaining means is selectively disengageable by the user.

When the user disengages the retaining means, the biasing means causes the arm to move outwardly or inwardly, depending on the embodiment, thereby automatically returning the head to the initial extended or contracted position.

A thumb lever is also provided in the handle which may be attached to the arm to aid in the selective movement of the arm with respect to the handle.

The head may be removed from the handle and arm to be replaced with a head having a nut receiving aperture of a different dimension, thus providing an economical means for manipulating nuts and bolts of various sizes.

It is then an object of this invention to provide an improved variable adjustable wrench which automatically returns the head to an initial angle when so desired.

Another object of this invention is to provide a variable adjustable wrench having an automatic return in which the heads are removable such that heads accommodating various sized nuts or bolts may be used in conjunction with the same tool.

Another object of the invention is to provide an automatic return variable adjustable wrench which contains a thumb lever to aid in the movement of the arm which causes the head to be positioned in a specific angle.

Other and further objects of this invention will become apparent to those skilled in this art from the following detailed description of several preferred embodiments of the invention showing a best mode of the invention.

ON THE DRAWINGS

FIG. 1 is a top perspective view of a variable adjustable wrench of this invention as used by a user.

FIG. 2 is a top sectional view partially cut away to show the interior of the handle of the wrench shown in FIG. 1.

FIG. 3 is a side elevational view of the wrench shown in FIG. 2.

FIG. 4 is a cross-sectional view along the lines IV—IV of FIG. 2.

FIG. 5 is a fragmentary cross-sectional view along the lines V—V of FIG. 3.

FIG. 6 is a top elevational view of an alternative embodiment of the wrench shown in FIG. 1 partially cut away to show the interior of the handle.

FIG. 7 is a side elevational view of the wrench shown in FIG. 6.

FIG. 8 is a partial cross-sectional view taken along the lines VIII—VIII of FIG. 7.

FIG. 9 is an exploded perspective view of the head and attachment means of the wrench as shown in FIGS. 2 and 6.

FIG. 10 is a top elevational view of an alternative embodiment of the wrench partially cut away to show the interior of the handle.

FIG. 11 is a top elevational view of an alternative embodiment of the wrench with the position of the thumb lever changed and partially sectioned.

FIG. 12 is a side elevational view of the wrench shown in FIG. 11.

FIG. 13 is a top elevational view of the wrench shown in FIG. 11.

FIG. 14 is a partial sectional view of the wrench shown in FIG. 10 showing in detail an alternative embodiment of the ratchet locking mechanism.

AS SHOWN ON THE DRAWINGS

The wrench 10 shown in FIGS. 1 through 3 has a handle 11 having a gripping portion 12 suitable to be held in the hand H of a user and a projecting bar or arm member 13.

The gripping portion 12 has a hollow interior 14 bounded by side walls 15, 16, rear end wall 17 and front wall 18. Front wall 18 has an aperture 19 therethrough for receiving an arm 20. Side wall 15 has a slot-type opening 21 therein for receiving a thumb lever 22. A face plate 23 forms a top surface of the gripping portion 12 of the wrench 10. The face plate 23 may be fastened to the handle 11 by appropriate fastening means such as screws 24, 24.

The arm 20 is an elongated member which is slidingly receivable with the handle 11 having a rear end 25 carried within the hollow interior 14 of the gripping portion 12 and a front end 26 protruding through the aperture 19 in the front wall 18 of the gripping portion 12 such that the arm 20 and the bar portion 13 of the handle 11 are essentially parallel. The front end 26 of the arm 20 is located relatively close to a front end 27 of the bar portion 13.

The arm 20 is movable between a first or extended position wherein the front end 26 of the arm 20 projects beyond the front end 27 of the bar portion 13 to a second or contracted position wherein the front end of the bar portion 13 projects beyond the front end 26 of the arm 20.

Projecting beyond the rear end of the arm 20 is a pin 28 which receives and carries a long coil spring 29. The spring 29 is sized such that a front end 30 which is carried on the pin 28 abuts against the rear end 25 of the arm 20 and a rear end 31 abuts against the rear wall 17 of the gripping portion 12 of the handle 11. The spring 29 is compressed so as to continuously urge the arm 20 outwardly from the interior 14 of the gripping portion 12 toward the first position.

As best seen in FIG. 3, the front end 26 of arm 20 has a reduced thickness as at 32 and on this portion is formed a perpendicular lug 33. Bar portion 13 of the handle 11 also has a reduced thickness portion on which is formed a second lug 34.

A head 35 having a front opening 36 is provided which has a rear end 37, a pair of reduced thickness portions 38, 39 each having a hole 40, 41 therethrough. This is best seen in FIGS. 4 and 9. The lugs 33, 34 are of a sufficient length to protrude beyond a bottom face 42 of the head 35 and each contain an annular channel 43, 44 for receiving a snap ring 45, 46. The snap rings 45, 46 operate to retain the head 35 on the lugs 33, 34, however also allow the head 35 to be removed from the lugs 33, 34 and replaced with a different head. In this manner, heads having differing sized front openings 36 for receiving different sized nuts and bolts may be selectively attached to the wrench 10 for manipulating various sized nuts and bolts.

A retaining means or locking device is shown generally at 47 in FIGS. 2, 3 and 5, and is used to retain the arm 20 in a fixed position relative to the handle 11 while the wrench 10 is applying a turning force to a nut or bolt. One embodiment of the retaining means 47 shown in FIGS. 1, 2, 3 and 5, is comprised of a dog 48 which has an aperture 49 therethrough for receiving an intermediate portion of the arm 20. One side 50 of the dog 48 is pivotally received in a channel 51 provided in the handle 11. The aperture 49 through the dog 48 is sized to be slightly greater than the dimensions of the arm 20 such that when the dog 48 is sized to be slightly greater than the dimensions of the arm 20 such that when the dog 48 is in a position perpendicular to the arm 20 as shown in phantom at 52 (FIG. 5), the arm 20 moves freely with respect to the dog 48. However, when the dog 48 is inclined slightly from the perpendicular position, such as shown in the solid lines, side walls 53 of the aperture 49 abut against the arm 20 restricting its movement.

To more effectively restrict this movement, a notched or knurled portion 54 is provided on a side wall 55 of the arm 20 closest to the channel 51 which engages a corner 56 of the aperture 49 when the dog 48 is angled with respect to the arm 20 so as to prevent outward movement of the arm 20. A biasing spring 57 is provided near a free end 58 of the dog 48 between the dog 48 and a handle 11 to constantly urge the dog 48 into a position which locks the arm 20 against outward movement. A force directed along arrow 59 (FIG. 5) will overcome the tension of the spring 57, thereby releasing the arm 20 from movement restriction. As can be seen in the drawing, that is, it is restricted from moving in an outward direction unless the dog 48 is moved into the phantom position 52.

The thumb lever 22 is attached to an intermediate portion of the arm 20 which can be carried within the hollow interior 14 of the handle 11 and is of a length sufficient to protrude beyond the handle 11 through the slot-type opening 21 provided in the side wall 15. The thumb lever 22 can be used to retract the arm 20 into the handle 11 even though the dog 48 is in its normally biased position since the notched or knurled portion 54 acts as a ratchet. If the dog 48 is moved to the perpendicular phantom position 52, the spring 29 will cause the arm 20 to move outwardly from the interior 14 of the handle 11 to the first or extended position. From this first position, the thumb lever may be used to retract the arm 20 to the desired position between the first and second positions.

A second embodiment of the invention is shown in FIGS. 6, 7 and 8 in which a slightly different retaining means 47*a* is used to restrict movement of the arm 20 during operation. All of the elements described above except for the retaining means 47 are present in the second embodiment and function in the same manner.

Retaining means 47*a* is comprised of a dog 60 having at least one tooth 61 at a rear top end and a pivot 62 near the front end such that the dog 60 is free to move about the pivot in an up and down manner within the hollow interior 14 of the handle 11 adjacent the thumb lever 22 on the arm 20 but an opposite side of the arm 20. The teeth 61 of the dog 60 are received in a series of ratchet notches 63 which are formed in the arm 20 on a side 64 opposite the thumb lever 22. A biasing spring 65 is received in a bore 66 in a bottom wall 67 of the dog 60 and is captured at an opposite end in a shallow bore 68 in the side wall 16 of the handle 11. The spring 65 constantly urges the dog teeth 61 into engagement with the ratchet notches 63 in the arm 20.

A thumb release member 69 is provided between the arm 20 and the bar portion 13 which has a thumb engaging portion 69*a* at a first end and a long thin connecting portion 69*b* which abuts a stop 67*a* on the dog 60.

The dog 60 can be rotated about pivot 62 by applying a rearward force on the thumb engaging portion 69*a* moving the thumb release member rearwardly causing the dog 67 to rotate about pivot 62 into the position shown in phantom in FIG. 8 as 60*a*. Thus, as seen in phantom, the teeth 61*a* of the rotated dog 60*a* are disengaged from the notches 63*a*. This disengagement permits the spring 29 to return the arm 20 to the first or extended position from where it can be selectively moved by the user by means of the thumb lever 22.

Another embodiment of the present invention is shown in FIG. 10 where it is seen that there is provided a wall 71 within the hollow handle interior 14 which has an aperture 72 therethrough for receiving a portion of the pin 28*a* extending from the arm 20. The pin 28*a* has a stop 73 formed at an end thereof and a biasing spring 29*a* is captured on the pin 28*a* between the wall 71 and the stop 73. In this embodiment, the biasing spring 29*a* continuously urges the arm 20 in a rearward or contracted position as opposed to the extended position as described in the embodiments shown in FIGS. 1–9.

Similar to the mechanism described above, there is provided a dog 74 which is pivoted at 75. The dog 74 has at least one tooth 76 engageable at a front top end.

The teeth 76 on the dog 74 are received in a series of ratchet notches 77 which are formed in the arm 20 as described above, but in opposite orientation, such that the ratchet notches 77 and the dog teeth 76 coact to prevent the arm 20 from moving rearwardly, but allow its forward movement.

A thumb release member 78 is provided as above which has a thumb engaging portion 78*a* and a connecting portion 78*b* which abuts a stop 74*a* on the dog 74. The dog 74 can be rotated about pivot 75 by applying a rearward force on the thumb engaging portion 78*a*.

A biasing spring 79 is captured in a bore 80 in the dog 74 to constantly urge the dog 74 in an upward direction to cause the dog teeth 76 to engage the ratchet notches 77. The bias of the spring 79 is overcome by the rearward force on the thumb release member 78. When the thumb release member 78 is pushed rearwardly, the dog teeth 76 disengage from the ratchet notches 77 and the biasing spring 29*a* causes the arm 20 to move to the rearward contracted position whereby the arm 20 will be short of the bar 13. A thumb lever 81 is used to move the arm 20 towards the forward extended position.

FIGS. 11, 12 and 13 show an alternative embodiment of the wrench of FIGS. 1–9 in which the thumb lever 22*a* extends through the top face plate 23 and a bottom wall 82 at a slotted opening 83 rather than through the sidewall 15. In all other respects, the structure and function of the wrench of FIGS. 11–13 is similar to that described above.

FIG. 14 shows an alternative embodiment of the wrench shown in FIG. 10 in which the thumb release mechanism 78*a* is formed as a part of the dog 74*b*. In this embodiment, the dog 74*b* has an outwardly extending thumb engaging knob 84 which projects through an opening 85 in the top face plate 23 of the handle 11. The thumb knob 84 can be pushed downwardly against the bias of spring 79 to cause the dog teeth 76 to become disengaged from the ratchet notches 77 on the arm 20 as the dog 74*a* rotates about pivot 75. In this manner, the spring 29*a* will cause the arm 20 to move rearwardly to the contracted position. The arm 20 can be moved forwardly by forward pressure on the thumb lever 81.

The automatic return variable adjustable wrench of the present invention is thus operated as follows: As seen in FIG. 1, the user of the wrench 10 manipulates the head 35 such that the front opening 36 engages a nut N. This manipulation may be done by selectively engaging and disengaging the dog 48 thereby permitting the arm 20 to oscillate in and out of the handle 11 permitting the head 35 to rotate. When the nut N is engaged in the opening 36, the gripping portion 12 of the wrench 10 can be oscillated side-to-side, the length of travel being dictated by the obstacles present in the area of operation.

The method of tightening a nut is shown in FIG. 1 and as the wrench 10 is rotated clockwise, the nut will be tightened and all of the elements of the wrench will be held in fixed relationship. At the end of the clockwise movement, the wrench can then be rotated in a counterclockwise direction with the opening 36 still engaging the nut N. During this counterclockwise rotation, the retaining means 47 will permit the arm 20 to slide further into the gripping portion 12 of the handle 11 thus changing the angular relation between the head 35 and the handle 11. At the end of the counterclockwise rotation, the procedure may be repeated. This repetition may continue until the arm 20 has travelled to the second or retracted position which is the limit of its travel. At this point the opening 36 of the head 35 is disengaged from the nut N and the retaining means 47 is released by the user so that the return spring 29 will cause the arm 20 to return to the first or extended position wherein the entire procedure may be repeated.

Loosening a nut or bolt is carried out in the same manner except that the wrench 10 is rotated 180° about its longitudinal axis so that the angular relationship between the head 35 and the handle 11 is constant during the counterclockwise rotation or loosening movement and the angular relationship changes during the clockwise rotation.

Operation of the alternative embodiment shown in FIGS. 6, 7, 11, 12 and 13 is the same described above, thumb release member 69 being used to disengage the retaining means 47*a*. Similarly, the operation of the alternative embodiment shown in FIGS. 10 and 14 is the same as described above, only the wrench is in a position rotated 180° about its longitudinal axis from that described in each step above.

From the above description it will be readily understood that this invention provides an automatic return variable adjustable wrench having removable and replaceable heads which are adapted to receive varying sized nuts or bolts. The head of the wrench pivots to change the angular relationship between the head and the handle of the wrench such that the head may be positioned to receive a nut which is in a somewhat inaccessible location. A retaining means comprised of a dog and ratchet mechanism permits a loosening or tightening to be carried out despite limited travel available for the handle of the wrench. A return spring is also provided to return the head to the starting position to assist the user.

I claim as my invention:

1. A wrench tool comprising:

a handle member, an arm member slidingly engageable between an extended position and a retracted position with said handle member, a wrench head releasably and pivotally attached to said handle member and said arm, a locking device securing said arm and handle together to hold the head in a fixed selected position on the arm and handle during a rotation of the wrench handle in one direction while allowing limited shifting of the arm relative to the handle when the handle is rotated in the opposite direction, and means for releasing said locking device and biasing means for returning said arm to an initial position when said locking means is released.

2. An end wrench comprising a pair of elongated members in side-by-side relation, and having laterally spaced adjacent ends, a wrench head projecting from said ends and releasably and pivotally connected thereto to be angularly shifted as one end is projected beyond the other, a thumb released locking device securing the members against shifting to hold the head in fixed position therewith, and means biasing one member so that one member extends beyond the other member when the locking member is released.

3. A wrench for tightening and loosening nuts and bolts in somewhat inaccessible locations which comprises a handle having a hollow grip piece with a projecting bar member, an arm slidingly engageable longitudinally with said hollow grip piece, biasing means carried within said hollow grip piece to urge said arm longitudinally, a removable wrench head pivotally attached to perpendicular lugs on said arm and said bar which are releasably received in holes in said wrench head, and means for selectively retaining said arm in a fixed position with respect to said handle.

4. A wrench tool having:

a removable head, said head having a nut receiving opening on a front end and a reduced thickness portion on a rear end, said reduced thickness portion having a pair of laterally spaced holes, a handle having a hollow housing at a rear end and a projecting arm with a front end beyond the housing, a second arm alongside the projecting arm having a rear end slidable in said housing and a front end alongside the front end of the projecting arm, said rear end of said second arm having a pin in the housing, a coil spring on said pin, said coil spring urging said second arm longitudinally relative to the housing, a thumb lever on the second arm projecting beyond said housing, perpendicular lugs on the front ends of the arm releasably received in said holes of the head, and means for retaining said second arm in a select fixed position relative to said housing.

5. The wrench of claim 1, wherein one end of said arm is received within said handle member.

6. The wrench of claim 1, wherein said biasing means is comprised of a coil spring abutting at one end against said handle and at an opposite end against said arm.

7. The wrench of claim 1, wherein said locking device is comprised of a dog and ratchet mechanism permitting movement in one direction and restricting movement in an opposite direction.

8. The wrench of claim 1, wherein the extended position is characterized by an end of said arm projecting beyond an end of said handle and the retracted position is characterized by said end of said handle projecting beyond said end of said arm.

9. The wrench of claim 1 wherein said initial position is said extended position.

10. The wrench of claim 1 wherein said initial positon is said contracted position.

11. The wrench of claim 2 wherein the biased member is baised to extend beyond the other member.

12. The wrench of claim 2 wherein the biased member is biased to be short of the other member.

13. The wrench of claim 3, further characterized by a thumb lever carried on said arm for assisting in the longitudinal movement of said arm.

14. The wrench of claim 3, wherein said biasing means urges said arm longitudinally outwardly.

15. The wrench of claim 3, wherein said biasing means urges said arm longitudinally inwardly.

16. The wrench of claim 11, wherein said retaining means permits said arm to move inwardly without restriction to a contracted limit but restricts outward movement of said arm unless disengaged.

17. The wrench of claim 12, wherein said retaining means permits said arm to move outwardly without restriction to a contracted limit but restricts inward movement of said arm unless disengaged.

18. The device of claim 4, wherein said retaining means is comprised of a dog having an aperture therethrough for receiving an intermediate portion of said second arm, said dog being pivotally received in a channel in said handle and, said aperture sized to be slightly greater than the dimensions of the arm such that when the dog is in a position perpendicular to the arm, the arm moves freely with respect to the dog, however when the dog is inclined slightly from the perpendicular position, side walls of the aperture abut against the arm restricting its movement.

19. The wrench of claim 18, wherein a biasing spring is provided to continuously urge said dog in an inclined position.

20. The wrench of claim 18, wherein said arm has a notched portion provided on a side wall closest to said channel to engage a corner of the aperture when the dog is in an inclined position.

21. The wrench of claim 4, wherein said coil spring urges said second arm longitudinally outwardly from the housing.

22. The wrench of claim 4, wherein said coil spring urges said second arm longitudinally inwardly into said housing.

23. The wrench of claim 4, wherein said retaining means is comprised of a dog having at least one tooth at a rear top end and a pivot near the front end such that said dog is free to move about said pivot in an up and down manner within said hollow interior of said handle to abut said arm adajcent said thumb lever, but on an opposite side of said arm, said tooth engageable with a series of ratchet notches formed in said arm on the portion abutted by said dog tooth.

24. The wrench of claim 23, including a thumb release member wherein said dog can be disengaged from said arm by pressing rearwardly on said thumb lever.

25. The wrench of claim 4, wherein said restraining means is comprised of a dog having at least one tooth at a front top end and a pivot near the rear and such that said dog is free to move about pivot in an up and down manner within said hollow interior of said handle to abut said arm on an interior surface thereof, said tooth engageable with a series of ratchet notches formed in said arm on the portion abutted by said dog tooth.

26. The wrench of claim 25 including a thumb release member, wherein said dog can be disengaged from said arm by pressing rearwardly on said thumb release member.

27. The wrench of claim 25 including a thumb release know on said dog, wherein said dog can be disengaged from said arm by pressing downwardly on said thumb release knob.

* * * * *